US005084916A

United States Patent [19]

Austin

[11] Patent Number: 5,084,916

[45] Date of Patent: Feb. 4, 1992

[54] NECKTIE ASSEMBLY

[76] Inventor: Joseph R. Austin, 238 Isabella Ave., Irvington, N.J. 07111

[21] Appl. No.: 560,734

[22] Filed: Jul. 31, 1990

Related U.S. Application Data

[63] Continuation-in-part of Ser. No. 348,290, May 5, 1989.

[51] Int. Cl.[5] ..... A41D 25/02

[52] U.S. Cl. ..... 2/149; 2/150; 2/152 R; 2/153

[58] Field of Search ..... 2/149, 150, 152 R, 152 A, 2/153, 148, 154

[56] References Cited

U.S. PATENT DOCUMENTS

| | | | |
|---|---|---|---|
| 2,534,669 | 12/1950 | Hall | 2/150 |
| 3,364,500 | 1/1968 | Fox | 2/150 |
| 3,735,420 | 5/1973 | New | 2/150 |
| 3,745,614 | 7/1973 | Tsang | 2/152 |
| 4,504,979 | 3/1985 | Kawamura | 2/153 |
| 4,748,692 | 6/1988 | Fukushima | 2/150 |

FOREIGN PATENT DOCUMENTS

| | | | |
|---|---|---|---|
| 521800 | 2/1956 | Canada | 2/153 |
| 2326 | 11/1889 | Fed. Rep. of Germany | 2/149 |
| 144168 | 12/1935 | Fed. Rep. of Germany | 2/150 |
| 926790 | 10/1947 | France | 2/153 |
| 2298971 | 8/1976 | France | 2/149 |
| 2399221 | 4/1979 | France | 2/152 R |
| 0000894 | 11/1979 | World Int. Prop. O. | 2/150 |

*Primary Examiner*—Werner H. Schroeder
*Assistant Examiner*—Diana L. Biefeld
*Attorney, Agent, or Firm*—Paul Gauer

[57] ABSTRACT

A necktie assembly in which a reversible tie piece is held in place between interlocking front and rear tieknot shells by a slide bar and a bar lock, in which the front tieknot shell is an interchangeable part, the entire assembly is held around the neck by an adjustable band and a shadow bracket provides a raised or lowered affect to the tieknot.

5 Claims, 4 Drawing Sheets

19
11
13
2
14
12
10
2
15
16
20
18
17

24
25
21
17
18

21
24
25
18
17

NECKTIE ASSEMBLY

BACKGROUND OF THE INVENTION

Though numerous artificial neckties have been invented, none consist of tieknot shells which clamp together to hold a reversible tie piece in place in which interchangeable tieknot shell fronts provide a multitude of different decorative styles.

OBJECTS OF THE INVENTION

It is an object of this invention to provide a necktie assembly that can be quickly and easily integrated to form a secure non-shifting unit which is indistinguishable from a conventional necktie when fully assembled.

Another object of this invention is to provide interchangeable tieknot fronts so as to multiply the variety of tie decorations.

Another object of this invention is to provide a reversible tie piece which by itself doubles the decorative function of the tie and when used in conjunction with other interchangeable parts multiplies the decorative functionality geometrically.

Another object of this invention is to eliminate the tying, twisting, pulling, frictional movements associated with knotmaking on a conventional tie, thus enhancing the range of useable fabrics for tie making and extending the life of the tie.

Another object of this invention is to provide a shadow bracket which can alternately fix the tie knot in a raised or lower position.

Another object of this invention is to provide an adjustable neck band.

Another object of this invention is to provide smooth, groove-free neckwear of geometric symmetry and standard length.

Another object of this invention is to provide a tough, durable tieknot which is resistant to both scuffing and soiling.

SUMMARY OF THE INVENTION

This invention is a necktie assembly, in which a reversible tie piece is clasped between interlocking front and rear tieknot shells by a bar lock and slide bar. The front shell is an interchangeable part to provide a variety of colors and designs. The tieknot assembly and tie are held around the neck by an adjustable band. An optional shadow bracket provides a raised or lowered affect for the tieknot. An optional apron and an optional stocking lile apron provide added variety to the selection of colors and designs available.

DETAILED DESCRIPTION OF THE PREFERRED EMBODIMENT

Figure 1:
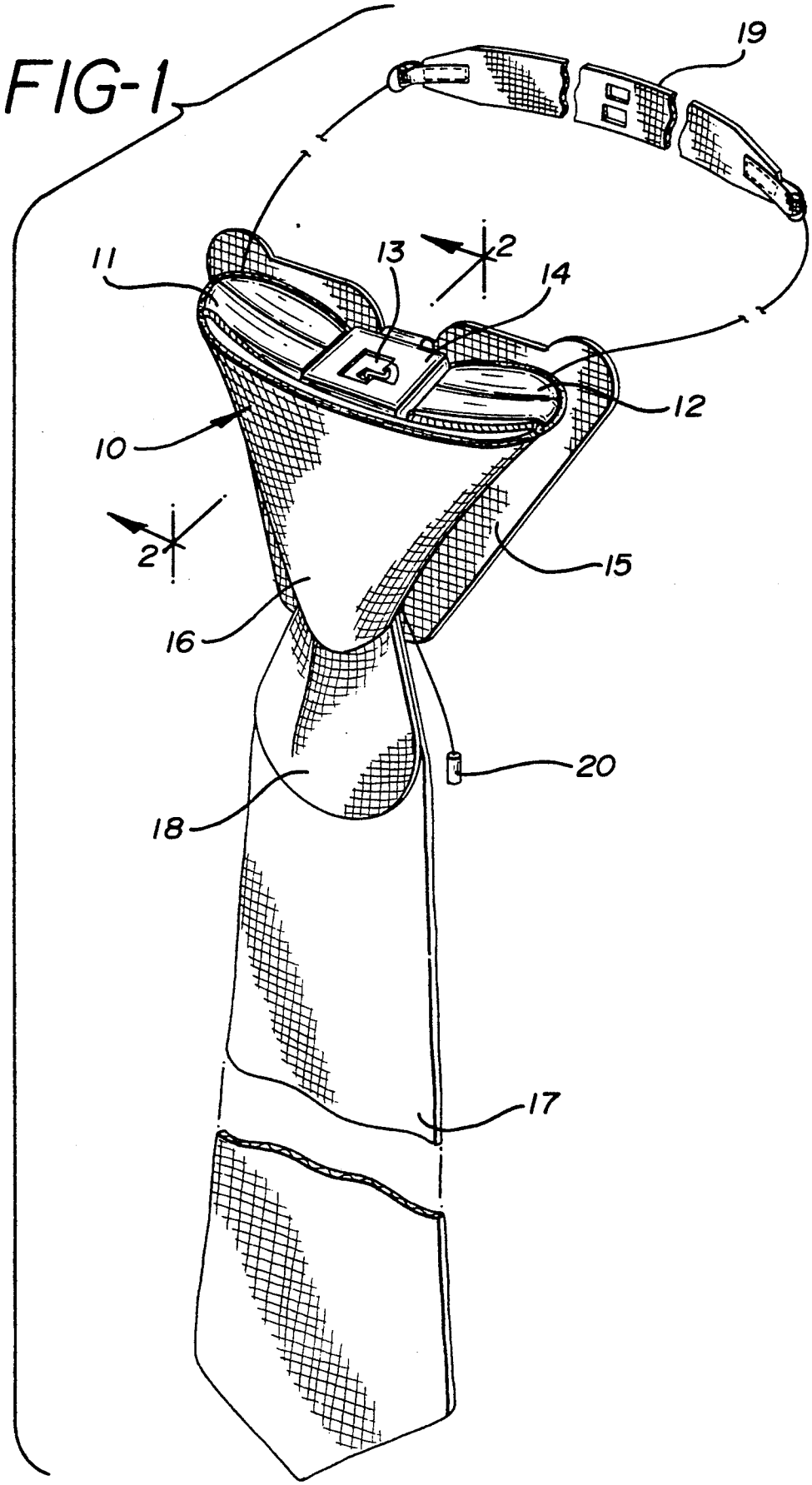
FIG. 1 is a perspective view.

FIG. 1, the perspective view, shows the preferred necktie assembly having a tie knot assembly 10 composed of an interchangeable front half shell 11, and a rear half shell 12, held together with a bar lock 13 which also secures the shadow bracket 14. The shadow 15, rides the rear of the tie knot assembly and the stocking lile apron 16, provides an optional decorative cover. The tie knot assembly 10, holds the tie 17 and the apron 18 in place between its two half shells. The entire device is held in place around the neck by the neck strap 19, which is tightened or loosened by pulling or releasing the weight tube 20.

Figure 2:
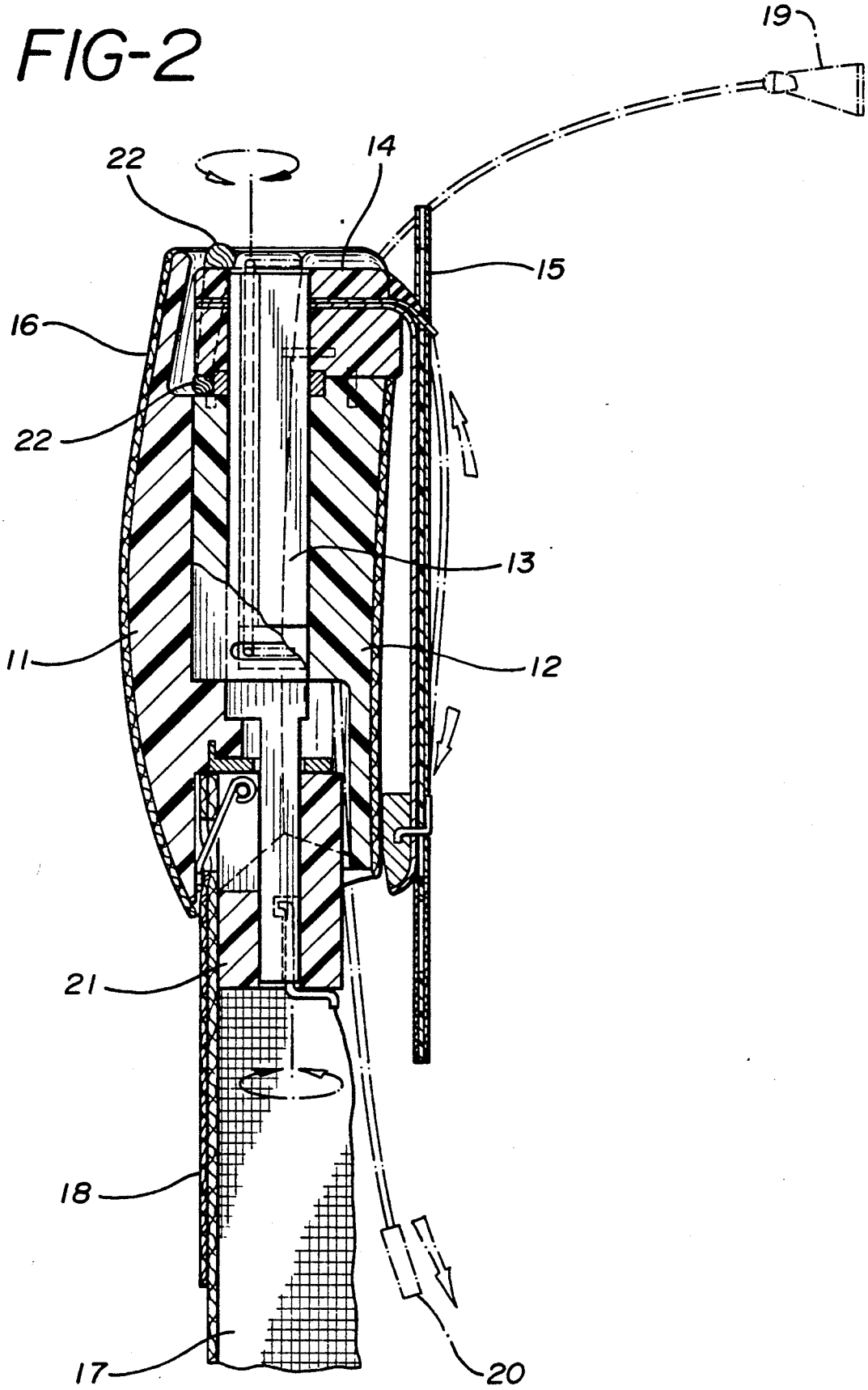
FIG. 2 is a cross section taken along lines 2—2 of FIG. 1.

FIG. 2, the cross section of FIG. 1 along lines 2—2, shows the interchangeable front half shell 11 and the rear half shell 12 clasping the tie 17 and the apron 18. The two half shells are themselves held in position by the bar lock 13, which passes through the shadow bracket 14, the rear half shell 12, the interchangeable front half shell 11, and the slide bar 21. The shadow bracket 14 holds the shadow 15 in place along the back of the rear half shell 12. The stocking lile apron 16 for the shell assembly covers the tie knot assembly 10 and is adjusted and secured by the stocking lile string 22. The entire device is held in place around the neck by the neck strap 19 which is adjusted by the weight tube 20.

Figure 3:
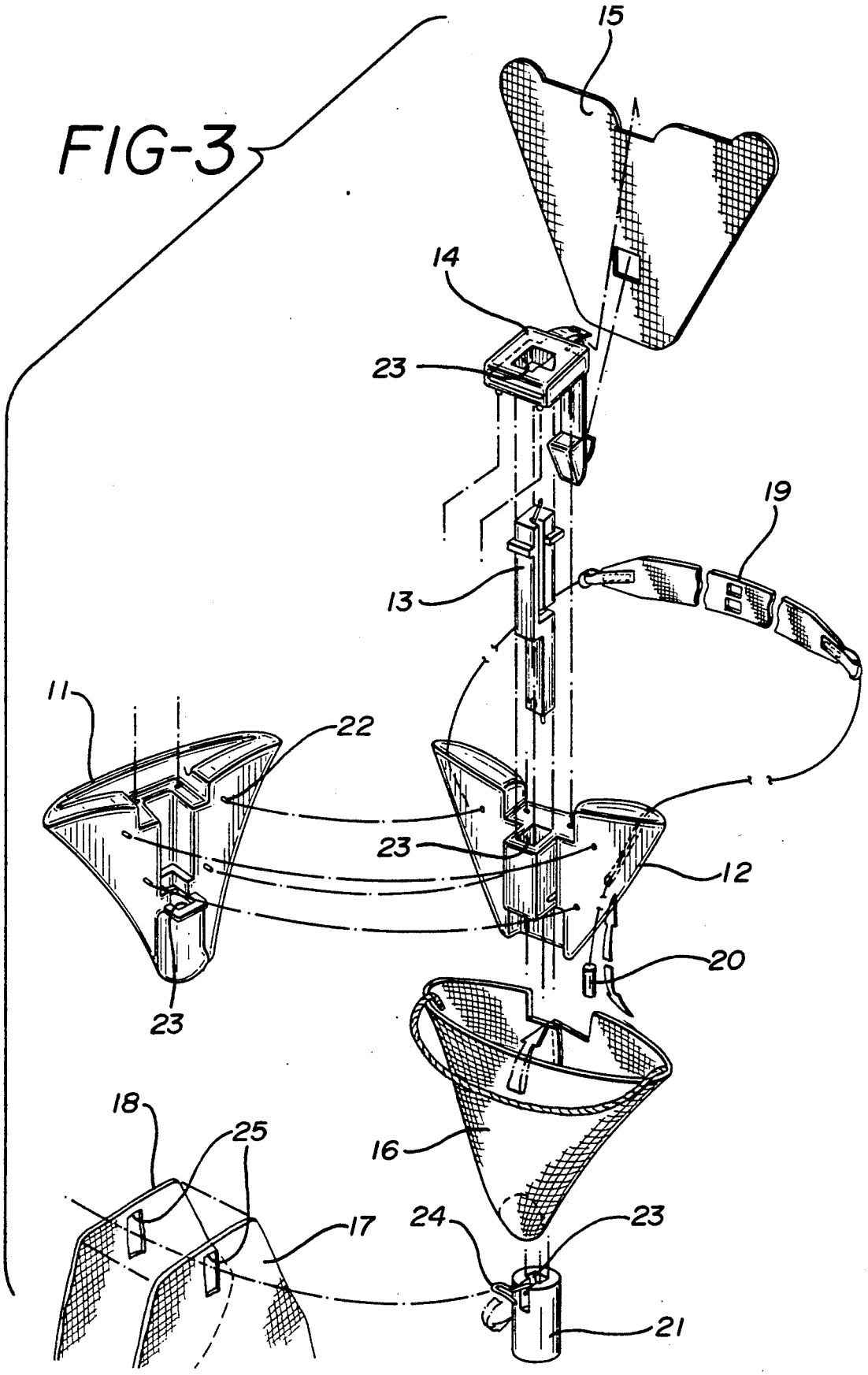
FIG. 3 is an exploded view of FIG. 1.

FIG. 3, the exploded view of FIG. 1, shows the necktie assembly having an interchangeable front half shell 11 which fits with a rear half shell 12 and these shell parts are aligned by pegs 22 and held together by passing a bar lock 13 through their alternating rectangular central apertures 23. The same bar lock 13 also holds the shadow bracket 14 and slide bar 21 in place on the assembly through their rectangular central apertures 23. The stocking lile apron 16 fits over the shell assembly when fully assembled. The slide bar 21 holds the tie 17 and apron 18 in place within the shell by means of a hook 24 which passes through a hole 25 in the apex of each. The shadow bracket 14 clasps the shadow 15 to the rear of the assembly. The neck strap 19 holds the tie and assembly around the neck and is adjusted by the weight tube 20.

Figure 4:
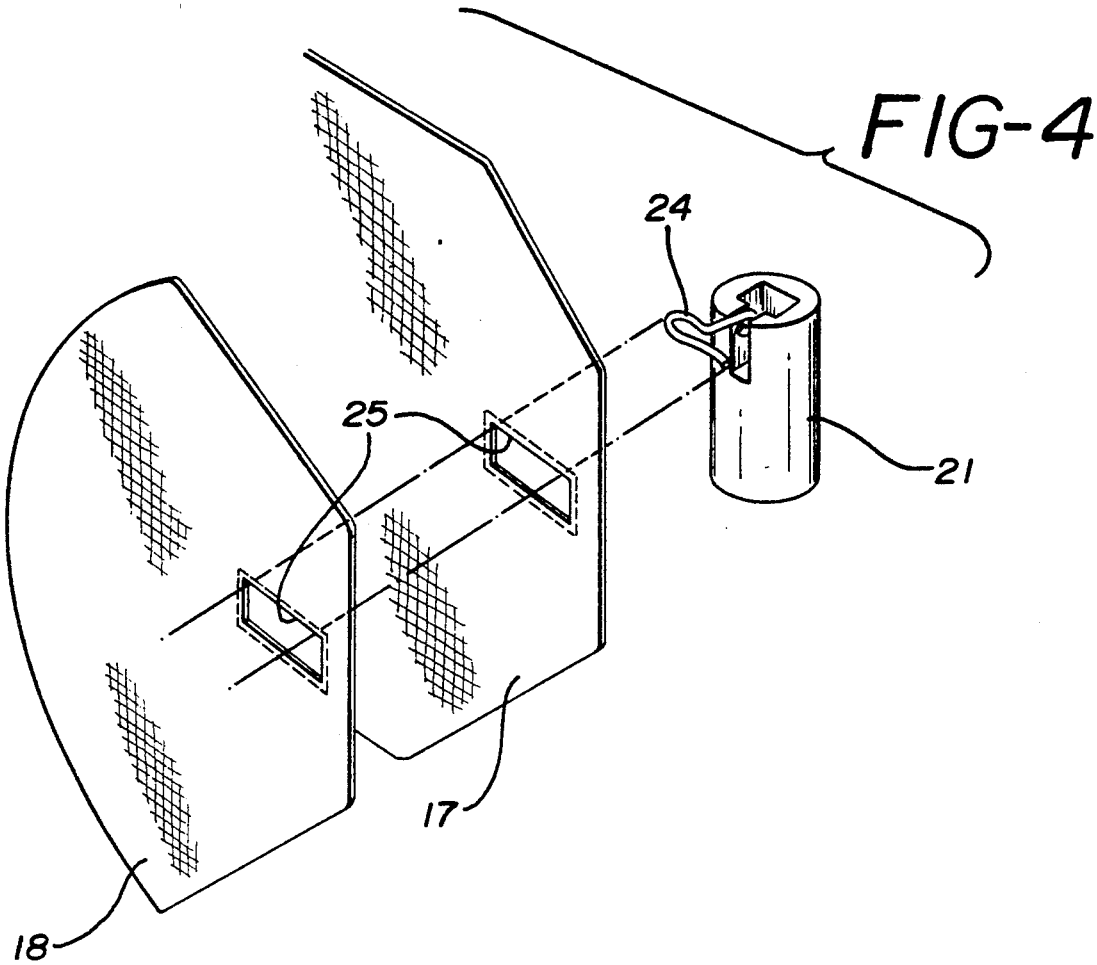
FIG. 4 is an exploded perspective view of the slide bar, tie & apron assembly.

FIG. 4, an exploded perspective view of the slide bar, tie and apron assembly, shows the slide bar 21 and how it connects with the tie 17 and apron 18 to clasp them within the overall assembly.

Figure 5:
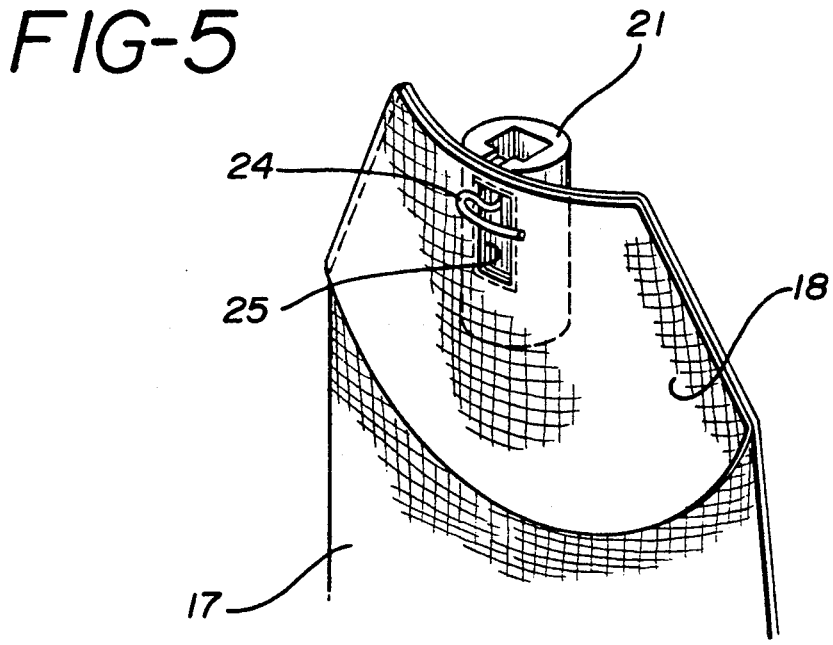
FIG. 5 is an assembled perspective view of FIG. 4.

FIG. 5, an assembled perspective view of FIG. 4, shows the tie 17 and apron 18 hanging from the hook 24 on the slide bar 21 which has passed through the apex hole 25 in each.

In use the neck strap 19 is typically placed around the neck and the rear half shell 12 is drawn closer to the neck by pulling the weight tube 20. The slide bar 21 holding the tie 17 and the apron 18 of the color selected is moved toward its position and the interchangeable front half shell 11 is aligned with the rear half shell 12. The stocking lile apron 16 is placed over the tie knot shell 10 and the slide bar 21 fixed into position. The bar lock 13 is inserted to secure the tie knot assembly 10, the slide bar 21 and the shadow bracket 14 holding the shadow 15. The entire device is then drawn to its final postion around the neck by pulling the weight tube 20.

I claim:

1. A necktie comprising:

a tie, interlocking front and rear tieknot shell halves having alternating rectangular central aperatures, a slide bar securing the tie between the shell halves comprised of a cylinder with a hook on its upper end and a rectangular hole in its center, a slidable bar lock securing the tieknot shell halves together, and a neck strap.

2. The necktie of claim 1, wherein the tie has a hole at its apex for connection with said slide bar.

3. The necktie of claim 1, wherein an apron with a hole at its apex is held between the shell halves in front of the tie by the slide bar.

4. The necktie of claim 1, having a shadow wherein the means for positioning the shadow so as to cause the tie knot to rise is a shadow bracket with a central rectangular aperture capable of accepting the bar lock of claim 1.

5. The necktie of claim 1, wherein the front shell is an interchangeable part with each alternate version having a different color or design.

* * * * *